US008803446B2

(12) United States Patent
Masumoto

(10) Patent No.: US 8,803,446 B2
(45) Date of Patent: Aug. 12, 2014

(54) LIGHTING APPARATUS

(71) Applicant: Panasonic Corporation, Osaka (JP)

(72) Inventor: Shingo Masumoto, Osaka (JP)

(73) Assignee: Panasonic Corporation, Osaka (JP)

( * ) Notice: Subject to any disclaimer, the term of this patent is extended or adjusted under 35 U.S.C. 154(b) by 48 days.

(21) Appl. No.: 13/706,843

(22) Filed: Dec. 6, 2012

(65) Prior Publication Data

US 2013/0147356 A1 Jun. 13, 2013

(30) Foreign Application Priority Data

Dec. 9, 2011 (JP) ..... 2011-270476

(51) Int. Cl.
*H05B 37/02* (2006.01)

(52) U.S. Cl.
USPC ..... 315/307; 315/308; 315/294; 315/312; 315/320

(58) Field of Classification Search
CPC ..... H05B 33/0815; H05B 33/0833; H05B 33/0851; H05B 33/0827; H05B 41/2828; Y02B 20/342; Y02B 20/347
USPC ..... 315/291, 294, 307, 308, 312, 318, 320, 315/360, 224
See application file for complete search history.

(56) References Cited

U.S. PATENT DOCUMENTS

| | | | | |
|---|---|---|---|---|
| 7,557,524 | B2 * | 7/2009 | Chevalier et al. | 315/318 |
| 8,294,074 | B2 * | 10/2012 | Lyons et al. | 250/205 |
| 8,324,840 | B2 * | 12/2012 | Shteynberg et al. | 315/308 |
| 8,339,053 | B2 * | 12/2012 | Yamasaki et al. | 315/209 R |
| 8,487,546 | B2 * | 7/2013 | Melanson | 315/291 |
| 8,508,150 | B2 * | 8/2013 | Kuo et al. | 315/291 |
| 2010/0219764 | A1 | 9/2010 | Yamasaki et al. | |
| 2010/0308739 | A1 | 12/2010 | Shteynberg et al. | |

FOREIGN PATENT DOCUMENTS

| | | | |
|---|---|---|---|
| EP | 2 233 826 | A1 | 9/2010 |
| JP | 2011-108669 | A | 6/2011 |
| WO | 02/51211 | A2 | 6/2002 |

OTHER PUBLICATIONS

European Search Report for corresponding European Application No. 12195791.4 dated Mar. 28, 2013.

* cited by examiner

*Primary Examiner* — Haiss Philogene
(74) *Attorney, Agent, or Firm* — Renner, Otto, Boisselle & Sklar, LLP

(57) ABSTRACT

The lighting apparatus in accordance with the present invention includes a dimming control unit configured to control, in accordance with a dimming ratio, a light source including a plurality of light emitting elements designed to emit light in response to DC power. The dimming control unit is configured to, when the dimming ratio falls within a first dimming range, vary supply power to the light source in accordance with the dimming ratio. The dimming control unit is configured to, when the dimming ratio falls within a second dimming range different from the first dimming range, vary, in accordance with the dimming ratio, a lighting number defined as the number of the light emitting elements to be lit.

15 Claims, 6 Drawing Sheets

LIGHTING APPARATUS

TECHNICAL FIELD

The present invention relates to lighting apparatuses, and more particularly to a lighting apparatus which uses, as a light source, a semiconductor light emitting element such as a light emitting diode and has a function of dimming the same.

BACKGROUND ART

For example, document 1 (JP 2011-108669 A) discloses a prior lighting apparatus for an LED exemplifying a semiconductor light emitting element.

As shown in FIG. 8, this prior instance is an LED dimming apparatus which includes: a current adjustment means (a constant current circuit 6) configured to vary a magnitude of a current flowing through an LED load 4; a switching means (a transistor Q1) configured to turn on and off the current flowing through the LED load 4; and a dimming control means (a microcomputer 5) configured to control the current adjustment means and the switching means in response to a dimming signal outputted from a dimmer 1. This LED dimming apparatus is characterized by the dimming control means. The dimming control means is designed to, when the dimming signal outputted from the dimmer 1 indicates luminance higher than that corresponding to a predetermined level, supply a continuous current to the LED load 4 and to dim the LED load 4 by means of adjusting the magnitude of the continuous current. The dimming control means is designed to, when the dimming signal outputted from the dimmer 1 indicates luminance lower than that corresponding to the predetermined level, supply a pulse current to the LED load 4 and to dim the LED load 4 by means of adjusting a duty ratio of a waveform of the pulse current.

When the LED load is not so dimmed but is relatively bright, the lighting apparatus changes the magnitude of the current flowing through the LED load. When the LED load is dimmed and is relatively dark, the lighting apparatus changes the duty ratio of the waveform of the pulse current. Thereby, the light apparatus can suppress noises while the LED load is relatively bright and can successfully maintain the luminance of the LED load even when the LED load is relatively dark.

With regard to a process of dimming the LED load by means of adjusting the magnitude of the current flowing through the LED load (hereinafter referred to as "DC dimming process"), it is difficult to dim the LED load at the lowered dimming level because individual V-I characteristics of LED elements are different and it is necessary to keep the current supplied to the LED elements not less than a predetermined current selected such that all the LED elements light successfully.

With regard to a process of dimming the LED load by means of adjusting the duty ratio of the waveform of the pulse current flowing through the LED load (hereinafter referred to as "PWM dimming process"), it is necessary to narrow a pulse width in order to dim the LED load at the lowered dimming level. It is difficult to stably control the LED load because a small change in the pulse width causes flickering of the LED load.

Consequently, it is not easy to dim the LED load at the lowered dimming level (e.g., the dimming ratio is equal to or less than 1%).

SUMMARY OF INVENTION

In view of the above problem, the present invention has aimed to propose a lighting apparatus capable of successfully performing the dimming control at the lowered dimming level.

The lighting apparatus of the first aspect in accordance with the present invention includes a dimming control unit configured to control, in accordance with a dimming ratio, a light source including a plurality of light emitting elements designed to emit light in response to DC power. The dimming control unit is configured to, when the dimming ratio falls within a first dimming range, vary supply power to the light source in accordance with the dimming ratio. The dimming control unit is configured to, when the dimming ratio falls within a second dimming range different from the first dimming range, vary, in accordance with the dimming ratio, a lighting number defined as the number of the light emitting elements to be lit.

In the lighting apparatus of the second aspect in accordance with the present invention, in addition to the first aspect, the second dimming range has an upper limit not greater than a lower limit of the first dimming range.

In the lighting apparatus of the third aspect in accordance with the present invention, in addition to the second aspect, the dimming control unit is configured to decrease the lighting number in response to a decrease in the dimming ratio in the second dimming range.

In the lighting apparatus of the fourth aspect in accordance with the present invention, in addition to any one of the first to third aspects, the dimming control unit is configured to adjust the supply power such that a decrease in luminance of the light source in a process of decreasing the lighting number is not greater than a predetermined value.

In the lighting apparatus of the fifth aspect in accordance with the present invention, in addition to the fourth aspect, the predetermined value is selected such that it is considered that the luminance of the light source changes continuously.

In the lighting apparatus of the sixth aspect in accordance with the present invention, in addition to any one of the first to third aspects, the second dimming range includes a plurality of auxiliary dimming intervals associated with the different lighting numbers respectively. The dimming control unit is configured to, when the auxiliary dimming interval is designated, adjust the lighting number to a value associated with the designated auxiliary dimming interval and change unit power supplied to each light emitting element to a value associated with the dimming ratio within a range of the unit power associated with the designated auxiliary dimming interval.

In the lighting apparatus of the seventh aspect in accordance with the present invention, in addition to the sixth aspect, a range of the unit power is determined such that a decrease in the luminance of the light source in the process of decreasing the lighting number is not greater than a predetermined value.

In the lighting apparatus of the eighth aspect in accordance with the present invention, in addition to the seventh aspect, the predetermined value is selected such that it is considered that the luminance of the light source changes continuously.

In the lighting apparatus of the ninth aspect in accordance with the present invention, in addition to any one of the first to eighth aspects, the dimming control unit is configured to vary the supply power by means of adjusting at least one of a magnitude and a duty ratio of a current supplied to the light source.

The lighting apparatus of the tenth aspect in accordance with the present invention further includes, in addition to any one of the first to ninth aspects, a lighting circuit configured to light the light source. The dimming control unit is configured to control the light source by use of the lighting circuit.

In the lighting apparatus of the eleventh aspect in accordance with the present invention, in addition to the tenth aspect, the lighting circuit includes: a current adjustment unit configured to supply currents to the plurality of the light emitting elements respectively; and a switch unit including a plurality of switching elements respectively connected in series with the plurality of the light emitting elements.

In the lighting apparatus of the twelfth aspect in accordance with the present invention, in addition to the eleventh aspect, the dimming control unit is configured to vary the supply power by means of adjusting a duty ratio of a current supplied to the light source by use of the switch unit.

In the lighting apparatus of the thirteenth aspect in accordance with the present invention, in addition to the eleventh or twelfth aspect, the dimming control unit is configured to vary the lighting number by use of the switch unit.

In the lighting apparatus of the fourteenth aspect in accordance with the present invention, in addition to any one of the tenth to twelfth aspects, the dimming control unit is configured to vary the supply power by means of adjusting a magnitude of a current supplied to the light source by use of the current adjustment unit.

In the lighting apparatus of the fifteenth aspect in accordance with the present invention, in addition to any one of the first to fourteenth aspects, the dimming control unit is configured to receive the dimming ratio from a dimming signal provided from a dimmer.

DESCRIPTION OF EMBODIMENTS

First Embodiment

Figure 1:
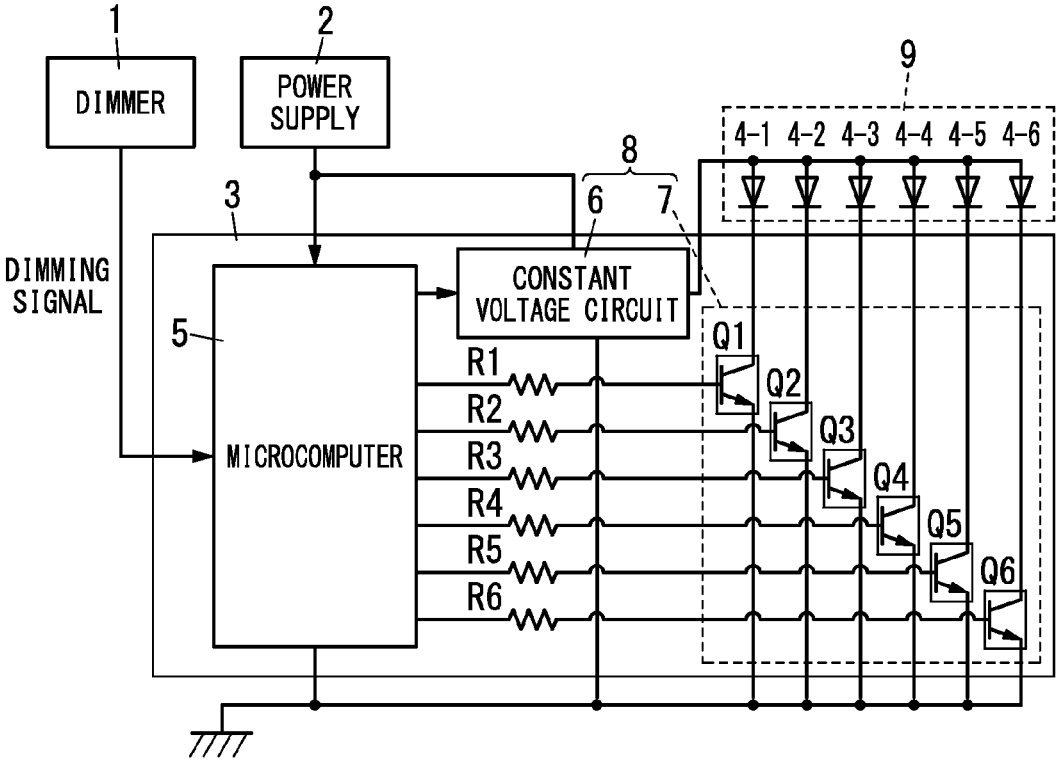
FIG. 1 is a block diagram illustrating the illuminating apparatus including the lighting apparatus of the first embodiment.

FIG. 1 shows a circuit configuration of an illuminating apparatus including a lighting apparatus 3 of the present embodiment.

The illuminating apparatus of the present embodiment includes a dimmer 1, a power supply 2, the lighting apparatus (LED lighting apparatus) 3, a plurality of (six, in the present embodiment) LED loads 4 (4-1 to 4-6).

The LED load 4 is a semiconductor light emitting element, for example. The plurality of the LED loads 4 (4-1 to 4-6) are connected in parallel with each other. The plurality of the LED loads 4-1 to 4-6 constitute a light source 9. In other words, the light source 9 includes the plurality of the light emitting elements (LED loads) 4 designed to emit light in response to DC power. Besides, the light emitting element is not limited to the LED load 4.

Additionally, the LED lighting apparatus 3 includes a microcomputer 5, a constant voltage circuit 6, a plurality of (six, in the present embodiment) resistors R1 to R6, and a plurality of (six, in the present embodiment) transistors (switching elements) Q1 to Q6.

The constant voltage circuit 6 is configured to output a constant voltage designated by a signal supplied from the microcomputer 5. The constant voltage circuit 6 constitutes a current adjustment unit configured to supply currents to the respective light emitting elements (LED loads) 4.

The plurality of the transistors (switching elements) Q1 to Q6 are connected in series with the plurality of the light emitting elements (LED loads) 4-1 to 4-6, respectively. Specifically, the transistors Q1 to Q6 are connected between a ground and cathodes of the LED loads 4-1 to 4-6, respectively. The plurality of the transistors Q1 to Q6 constitute a switching circuit 7 (switch unit). Besides, the plurality of the resistors R1 to R6 are connected between the microcomputer 5 and the plurality of the transistors Q1 to Q6, respectively.

In the present embodiment, the constant voltage circuit 6 (the current adjustment unit) and the switching circuit 7 (the switch unit) constitute a lighting circuit 8 configured to light the light source 9.

The microcomputer 5 serves as a dimming control unit configured to control the light source 9 in accordance with a dimming ratio. The microcomputer 5 is configured to receive the dimming ratio from a dimming signal provided from the dimmer 1, for example.

The microcomputer 5 is configured to control the light source 9 by use of the lighting circuit 8. The microcomputer 5 is configured to vary supply power by means of adjusting at least one of a magnitude and a duty ratio of a current (supply current) supplied to the light source 9.

For example, the microcomputer 5 is configured to vary the supply power by means of adjusting the duty ratio of the current supplied to the light source 9 by use of the switching circuit 7. Alternatively or additionally, the microcomputer 5 is configured to vary the supply power by means of adjusting the magnitude of the current supplied to the light source 9 by use of the constant voltage circuit 6.

As mentioned in the above, the microcomputer 5 has a function of reading the dimming signal from the dimmer 1 and turning on and off the transistors Q1 to Q6 and adjusting the voltage value (designated voltage) of the constant voltage circuit 6.

Figure 2:
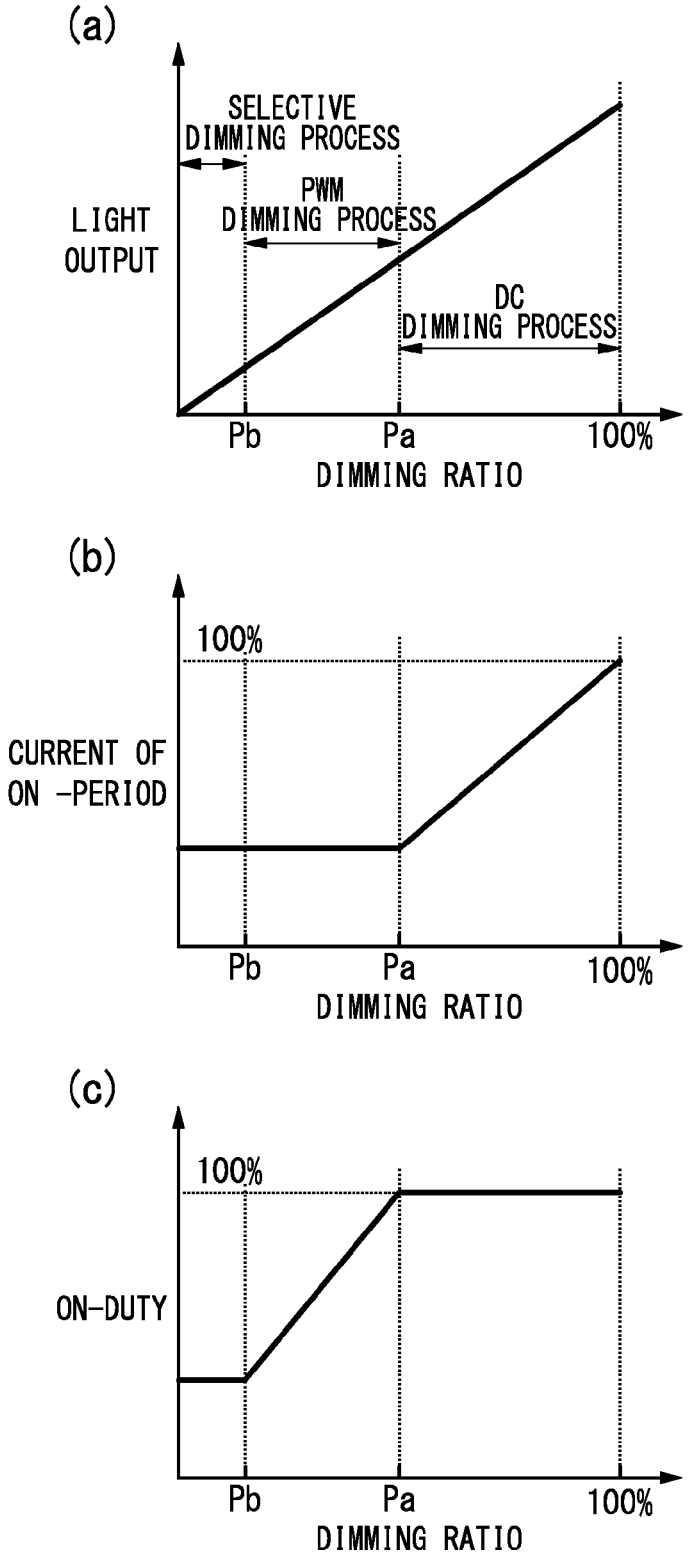
FIG. 2 is a diagram illustrating dimming characteristics of the lighting apparatus of the first embodiment.

As shown in FIG. 2 (*a*) to (*c*), the microcomputer 5 stores predetermined dimming ratios (dimming levels) Pa and Pb. When the dimming level is in a range which has a lower limit not lower than the dimming level Pa (the dimming ratio falls within the dimming range of Pa to an upper limit of a whole range of the dimming ratio), the microcomputer 5 performs a DC dimming process of keeping turning on the transistors Q1 to Q6 and varying the designated voltage (output voltage) of the constant voltage circuit 6, thereby varying the currents flowing through the respective LED loads 4-1 to 4-6.

When the dimming level is in a range which has an upper limit not higher than the dimming level Pa and has a lower limit not lower than the dimming level Pb (the dimming ratio falls within the dimming range of Pb to Pa), the microcomputer 5 performs a PWM dimming process of keeping the designated voltage of the constant voltage circuit 6 constant and turning on and off the transistors Q1 to Q6, thereby varying the duty ratio.

In other words, the microcomputer 5 is configured to, when the dimming ratio falls within a first dimming range (Pb to the upper limit of the whole range of the dimming ratio), vary the supply power to the light source 9 in accordance with the dimming ratio. For example, the upper limit of the whole range of the dimming ratio is 100%.

The first dimming range includes a plurality of dimming intervals. In the present embodiment, the first dimming range includes a first dimming interval and a second dimming interval. For example, the first dimming interval is defined as an interval of the dimming ratio of Pa to 100%. The second dimming interval is defined as an interval of the dimming ratio of Pb to Pa.

The first dimming interval is defined as an interval (DC dimming interval) within which the microcomputer 5 performs the DC dimming process. In other words, the microcomputer 5 keeps the lighting number and the duty ratio constant and varies the magnitude of the supply current in accordance with the dimming ratio.

When the dimming ratio falls within the first dimming interval (Pa to the upper limit of the whole range of the dimming ratio), the microcomputer 5 adjusts the lighting number to a value (of the lighting number) associated with the first dimming interval (six, in the present embodiment) and changes the duty ratio to a value (of the duty ratio) associated with the first dimming interval (in the present embodiment, a maximum value [e.g., 100%] of the duty ratio associated with the second dimming interval).

In addition, the microcomputer 5 adjusts the magnitude of the current (supply current) supplied to the light source 9 to a value (of the magnitude of the current) which is selected from a range of the supply current associated with the first dimming interval in accordance with the dimming ratio. For example, the microcomputer 5 adjusts the designated voltage (output voltage) of the constant voltage circuit 6 such that the magnitude of the supply current is equivalent to a value (of the magnitude of the supply current) corresponding to the dimming ratio within the range of the supply current associated with the first dimming interval. In the first dimming interval, the microcomputer 5 increases the supply current in response to an increase in the dimming ratio (see FIG. 2 (*b*)).

The second dimming interval is defined as an interval (PWM dimming interval) within which the microcomputer 5 performs the PWM dimming process. In other words, the microcomputer 5 keeps the lighting number and the supply current constant and varies the duty ratio in accordance with the dimming ratio.

When the dimming ratio falls within the second dimming interval (Pb to Pa), the microcomputer 5 adjusts the lighting number to a value (of the lighting number) associated with the second dimming interval (six, in the present embodiment) and changes the magnitude of the supply current to a value (of the magnitude of the supply current) associated with the second dimming interval (in the present embodiment, a minimum magnitude of the supply current associated with the first dimming interval).

In addition, the microcomputer 5 adjusts the duty ratio of the current (supply current) supplied to the light source 9 to a value (of the duty ratio) which is selected from a range of the duty ratio associated with the second dimming interval in accordance with the dimming ratio. For example, the microcomputer 5 controls each of the switching elements (transistors Q1 to Q6) of the switching circuit 7 such that the duty ratio is equivalent to a value (of the duty ratio) corresponding to the dimming ratio within the range of the duty ratio associated with the second dimming interval. In the second dimming interval, the microcomputer 5 increases the duty ratio in response to an increase in the dimming ratio (see FIG. 2 (*c*)).

Further, with regard to a range (the dimming range within which the dimming ratio is in a range of the lower limit of the whole range of the dimming ratio to Pb) having an upper limit not greater than the dimming level Pb, the microcomputer 5 performs a selective dimming process of varying the lighting number of the LEDs by means of turning off the switching elements Q1, Q2, . . . , Q6 in this order.

In other words, the microcomputer 5 is configured to, when the dimming ratio falls within the second dimming range (the range of the lower limit of the whole range of the dimming ratio to Pb), maintain the supply power to the light source 9 and vary, in accordance with the dimming ratio, the lighting number. For example, the lower limit of the whole range of the dimming ratio is 0%. The second dimming range defines an interval (a selective dimming interval) in which the microcomputer 5 performs the selective dimming process.

In the second dimming range, the microcomputer 5 maintains the magnitude and the duty ratio of the supply current, thereby maintaining the supply power. Therefore, the microcomputer 5 is configured to, when the dimming ratio falls within the second dimming range, adjust the duty ratio to a value (of the duty ratio) associated with the second dimming range (in the present embodiment, the minimum value of the duty ratio associated with the second dimming interval), and adjust the magnitude of the supply current to a value (of the magnitude of the supply current) associated with the second dimming range (in the present embodiment, the minimum value of the magnitude of the supply current associated with the first dimming interval).

Additionally, the microcomputer 5 is configured to adjust the lighting number to a value (of the lighting number) associated with the dimming ratio within the range of the lighting number associated with the second dimming range. For example, the microcomputer 5 controls each of the switching elements (transistors Q1 to Q6) of the switching circuit 7 such that the lighting number is identical to a value (of the lighting number) associated with the dimming ratio within the range of the lighting number associated with the second dimming range. The microcomputer 5 is configured to decrease the lighting number in response to a decrease in the dimming ratio in the second dimming range.

In brief, the microcomputer 5 is configured to, when the dimming ratio falls within the second dimming range (the lower limit of the whole range of the dimming ratio to Pb) different from the first dimming range (Pb to the upper limit of the whole range of the dimming ratio), vary, in accordance with the dimming ratio, the lighting number defined as the number of the light emitting elements (LED loads) 4 to be lit. The microcomputer 5 is configured to vary the lighting number by use of the switching circuit 7.

FIG. 2 shows an operation of the lighting apparatus 3 of the present embodiment. FIG. 2 (*a*) shows a relation between a level of a dimming signal output (the dimming ratio) and the light output. FIG. 2 (*b*) shows a relation between the level of the dimming signal output and the current (peak value) of an on-period (a period in which a current flows through the LED load 4) flowing through the LED load 4. FIG. 2 (*c*) shows a relation between the level of the dimming signal output and an on-duty (the duty ratio of the current supplied to the LED load 4) of the pulse waveform.

Figure 3:
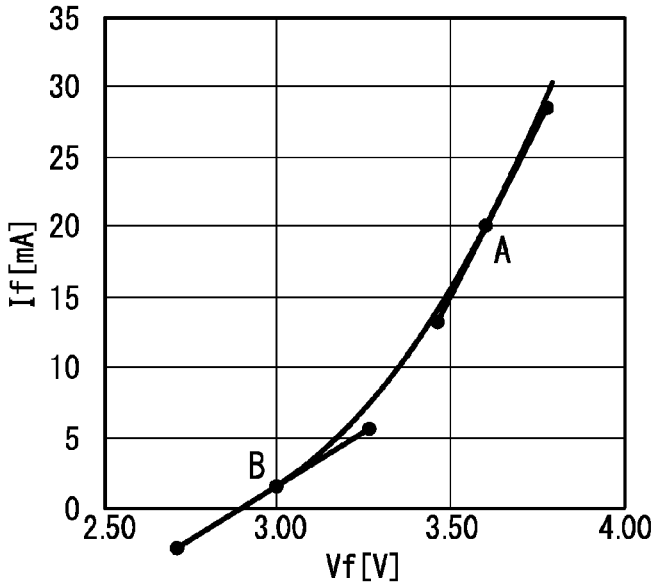
FIG. 3 is a diagram illustrating V-I characteristics of an LED used for the lighting apparatus of the first embodiment.

The dimming level Pa is selected in consideration of V-I characteristics of the LED element, for example. It is assumed that one LED element has the V-I characteristics as shown in FIG. b. With regard to FIG. 3, Vf represents a forward voltage, and If represents a forward current.

For example, $\Delta V/\Delta I$ at the rated current is defined as a value "A", and $\Delta V/\Delta I$ in a process of decreasing the current flowing through the LED element is defined as a value "B". The value "B" is increased with a decrease in the current flowing through the LED element.

When the value "B" becomes three to five times greater than the value "A", the LED element may become unstable, and a fluctuation may become greater. Therefore, the dimming level Pa shown in FIG. 2 is determined such that the DC dimming process is performed in the range in which the value "B" does not become three to five times greater than the value "A".

Further, the dimming level Pb is selected to be the lowest on-duty (duty ratio) that the microcomputer 5 successfully adjusts the pulse width. In the present embodiment, the light output is linearly decreased with regard to the dimming duty ratio (%). The characteristic line between the light output and the dimming duty ratio is not limited to a straight line but may be a curve.

As mentioned in the above, the lighting apparatus 3 of the present embodiment is a lighting apparatus is configured to light the plurality of the semiconductor light emitting elements (the LED loads 4). The lighting apparatus of the present embodiment includes the dimming control unit (the microcomputer 5). The dimming control unit (the microcomputer 5) is configured to perform at least one of the DC dimming process of varying the magnitude of the current flowing through the semiconductor light emitting elements and the PWM dimming process of turning on and off the current flowing through the semiconductor light emitting elements, in response to the dimming signal outputted from the dimmer 1. The lighting apparatus of the present embodiment is configured to, when the dimming signal outputted from the dimmer 1 indicates the luminance lower than that corresponding to the predetermined level, dim the semiconductor light emitting elements by use of the selective dimming process of decreasing the lighting number of the semiconductor light emitting elements.

In other words, the lighting apparatus 3 of the present embodiment includes the dimming control unit (the microcomputer 5) configured to control in accordance with the dimming ratio the light source 9 including the plurality of the light emitting elements (the LED loads 4) designed to emit light in response to DC power. The dimming control unit (the microcomputer 5) is configured to, when the dimming ratio falls within the first dimming range, vary the supply power to the light source 9 in accordance with the dimming ratio. The dimming control unit (the microcomputer 5) is configured to, when the dimming ratio falls within the second dimming range different from the first dimming range, vary, in accordance with the dimming ratio, the lighting number defined as the number of the light emitting elements (the LED loads 4) to be lit.

According to the lighting apparatus of the present embodiment as explained above, it is possible to successfully perform the dimming control at the lowered dimming level.

As mentioned in the above, the present embodiment can propose the LED dimming apparatus capable of successfully achieving the dimming control at the lowered dimming level (e.g., the dimming ratio is not greater than 1%) by means of performing the dimming control by use of the selective dimming process in addition to the DC dimming process and the PWM dimming process.

Further, in the lighting apparatus 3 of the present embodiment, the second dimming range has an upper limit (Pb, in the present embodiment) not greater than a lower limit (Pb, in the present embodiment) of the first dimming range. Besides, this configuration is optional.

Further, in the lighting apparatus 3 of the present embodiment, the dimming control unit (the microcomputer 5) is configured to decrease the lighting number in response to a decrease in the dimming ratio within the second dimming range. Besides, this configuration is optional.

Further, in the lighting apparatus 3 of the present embodiment, the dimming control unit (the microcomputer 5) is configured to vary the supply power by means of adjusting at least one of the magnitude and the duty ratio of the current supplied to the light source 9. Besides, this configuration is optional.

Further, the lighting apparatus 3 of the present embodiment further includes the lighting circuit 8 configured to light the light source 9. The dimming control unit (the microcomputer 5) is configured to control the light source 9 by use of the lighting circuit 8. Besides, this configuration is optional.

Further, in the lighting apparatus 3 of the present embodiment, the lighting circuit 8 includes: the current adjustment unit (the constant voltage circuit 6) configured to supply currents to the plurality of the light emitting elements (the LED loads 4) respectively; and the switch unit (the switching circuit 7) including the plurality of the switching elements (the transistors Q1 to Q6) respectively connected in series with the plurality of the light emitting elements (the LED loads 4). Besides, this configuration is optional.

Further, in the lighting apparatus 3 of the present embodiment, the dimming control unit (the microcomputer 5) is configured to vary the supply power by means of adjusting the duty ratio of the current supplied to the light source 9 by use of the switch unit (the switching circuit 7). Besides, this configuration is optional.

Further, in the lighting apparatus 3 of the present embodiment, the dimming control unit (the microcomputer 5) is configured to vary the lighting number by use of the switch unit (the switching circuit 7). Besides, this configuration is optional.

Further, in the lighting apparatus 3 of the present embodiment, the dimming control unit (the microcomputer 5) is configured to vary the supply power by means of adjusting the magnitude of the current supplied to the light source 9 by use of the current adjustment unit (the constant voltage circuit 6). Besides, this configuration is optional.

Further, in the lighting apparatus 3 of the present embodiment, the dimming control unit (the microcomputer 5) is configured to receive the dimming ratio from the dimming signal provided from the dimmer 1. Besides, this configuration is optional.

Besides, the dimming signal output of the dimmer 1 may be an analog signal (e.g., a signal having a DC voltage in a range of 0 V to 10 V), a duty signal (e.g., a signal having a frequency of 1 kHz and a voltage of 10 V), or a digital signal (e.g., a DMX signal).

Besides, the power supply 2 may be an AC power supply or a DC power supply.

Each of the LED loads 4 (4-1 to 4-6) may be an LED unit constituted by one LED element, or an LED unit constituted by a plurality of LED elements.

Recently, the output of the LED load has been increased. The use of the LED lighting apparatus 3 including the LEDs connected in parallel and/or in series has been increased. Therefore, it is effective to decrease the luminance by use of the selective dimming process.

Besides, a load designed to light in response to DC or pulse power supply (i.e., a load lights with DC power) may be used as an alternative to the LED load 4 (4-1 to 4-6). An organic EL element is also available.

In the PWM dimming process, the current flowing through the LED is a rectangular wave, which is the most effective waveform. Such a pulse waveform may be a sinusoidal waveform, or a triangular waveform, and may produce the same advantage so long as the current has a waveform other than a flat DC waveform.

The dimming means is not limited to a means of varying the on-duty while maintaining the PWM frequency, but may be selected from a means of varying the PWM frequency and a means of varying the on-period and/or the off-period, for example.

Second Embodiment

Figure 4:
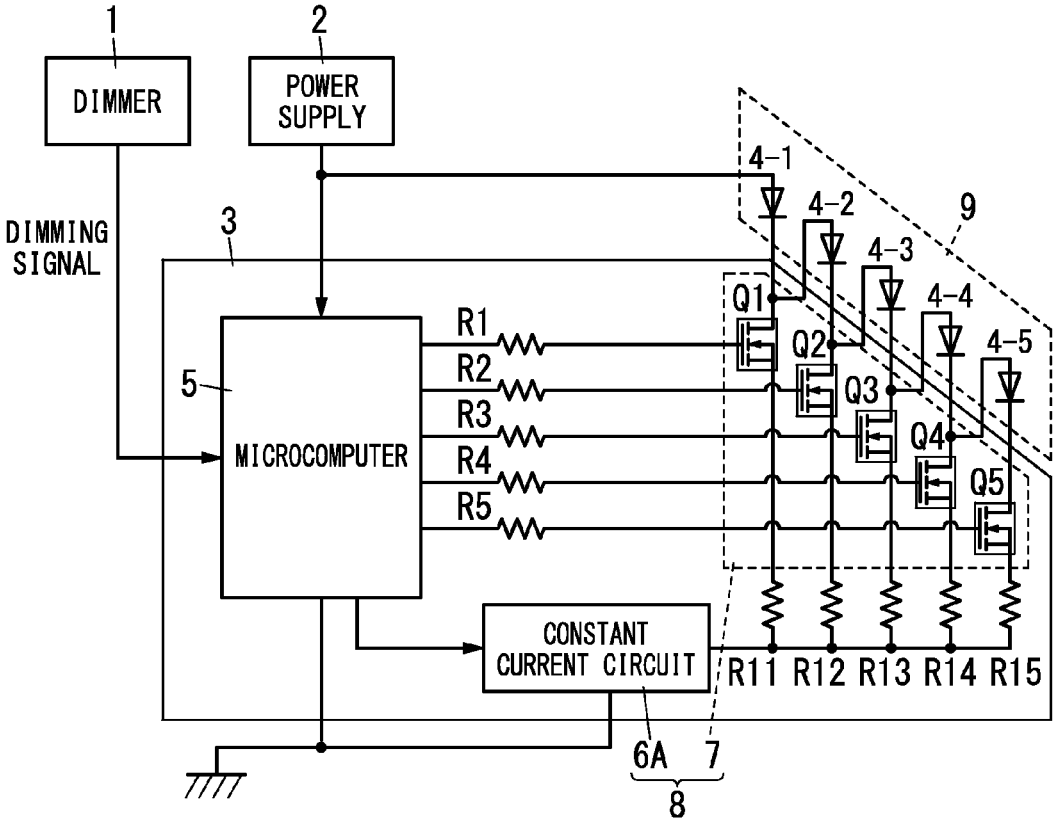
FIG. 4 is a block diagram illustrating the illuminating apparatus including the lighting apparatus of the second embodiment.

FIG. 4 shows a circuit configuration of the illuminating apparatus including the lighting apparatus 3 of the present embodiment.

The illuminating apparatus of the present embodiment includes the dimmer 1, the power supply 2, the lighting apparatus (LED lighting apparatus) 3, a plurality of (five, in the present embodiment) LED loads 4 (4-1 to 4-5).

The plurality of the LED loads 4 (4-1 to 4-5) constitute the light source 9. The plurality of the LED loads 4 (4-1 to 4-5) are connected in series with each other. The LED load 4-1 has a cathode connected to an anode of the LED load 4-2. The LED load 4-2 has a cathode connected to an anode of the LED load 4-3. The LED load 4-3 has a cathode connected to an anode of the LED load 4-4. The LED load 4-4 has a cathode connected to an anode of the LED load 4-5.

Additionally, the LED lighting apparatus 3 includes the microcomputer 5, a constant current circuit 6A, a plurality of (ten, in the present embodiment) resistors R1 to R5 and R11 to R15, and a plurality of (five, in the present embodiment) semiconductor switching elements (switching elements) Q1 to Q5. For example, the semiconductor switching elements are MOSFETs.

The constant current circuit 6A is configured to output a constant current (designated current) designated by a voltage signal supplied from the microcomputer 5. The constant current circuit 6A constitutes the current adjustment unit configured to supply currents to the respective light emitting elements (LED loads) 4.

The plurality of the switching elements Q1 to Q5 constitute the switch unit (the switching circuit 7). The switching element Q1 is connected between the constant current circuit 6A and a connection point of the LED loads 4-1 and 4-2. The switching element Q2 is connected between the constant current circuit 6A and a connection point of the LED loads 4-2 and 4-3. The switching element Q3 is connected between the constant current circuit 6A and a connection point of the LED loads 4-3 and 4-4. The switching element Q4 is connected between the constant current circuit 6A and a connection point of the LED loads 4-4 and 4-5. The switching element Q5 is connected between the constant current circuit 6A and a cathode of the LED load 4-5.

In the switching circuit 7, when the switching element Q5 is turned on and the remaining switching elements Q1 to Q4 are turned off, all of the LED loads 4-1 to 4-5 are turned on and thus the lighting number is five. When the switching element Q4 is turned on and the remaining switching elements Q1 to Q3 and Q5 are turned off, only the LED loads 4-1 to 4-4 are turned on and thus the lighting number is four. When the switching element Q3 is turned on and the remaining switching elements Q1, Q2, Q4 and Q5 are turned off, only the LED loads 4-1 to 4-3 are turned on and thus the lighting number is three. When the switching element Q2 is turned on and the remaining switching elements Q1 and Q3 to Q5 are turned off, only the LED loads 4-1 and 4-2 are turned on and thus the lighting number is two. When the switching element Q1 is turned on and the remaining switching elements Q2 to Q5 are turned off, only the LED load 4-1 is turned on and thus the lighting number is one.

Besides, the plurality of the resistors R1 to R5 are connected between the microcomputer 5 and the plurality of the switching elements Q1 to Q5, respectively. In addition, the plurality of the resistors R11 to R15 are connected between the constant current circuit 6A and the plurality of the switching elements Q1 to Q5, respectively.

In the present embodiment, the constant current circuit 6A (the current adjustment unit) and the switching circuit 7 (the switch unit) constitute the lighting circuit 8 configured to light the light source 9.

In the present embodiment, the microcomputer 5 is configured to vary the supply power by means of adjusting the duty ratio of the current supplied to the light source 9 by use of the switching circuit 7. Alternatively or additionally, the microcomputer 5 is configured to vary the supply power by means of adjusting the magnitude of the current supplied to the light source 9 by use of the constant current circuit 6A.

As mentioned in the above, the microcomputer 5 has a function of reading the dimming signal from the dimmer 1 and turning on and off the transistors Q1 to Q5 and adjusting the current value (designated current) of the constant current circuit 6A.

Figure 5:
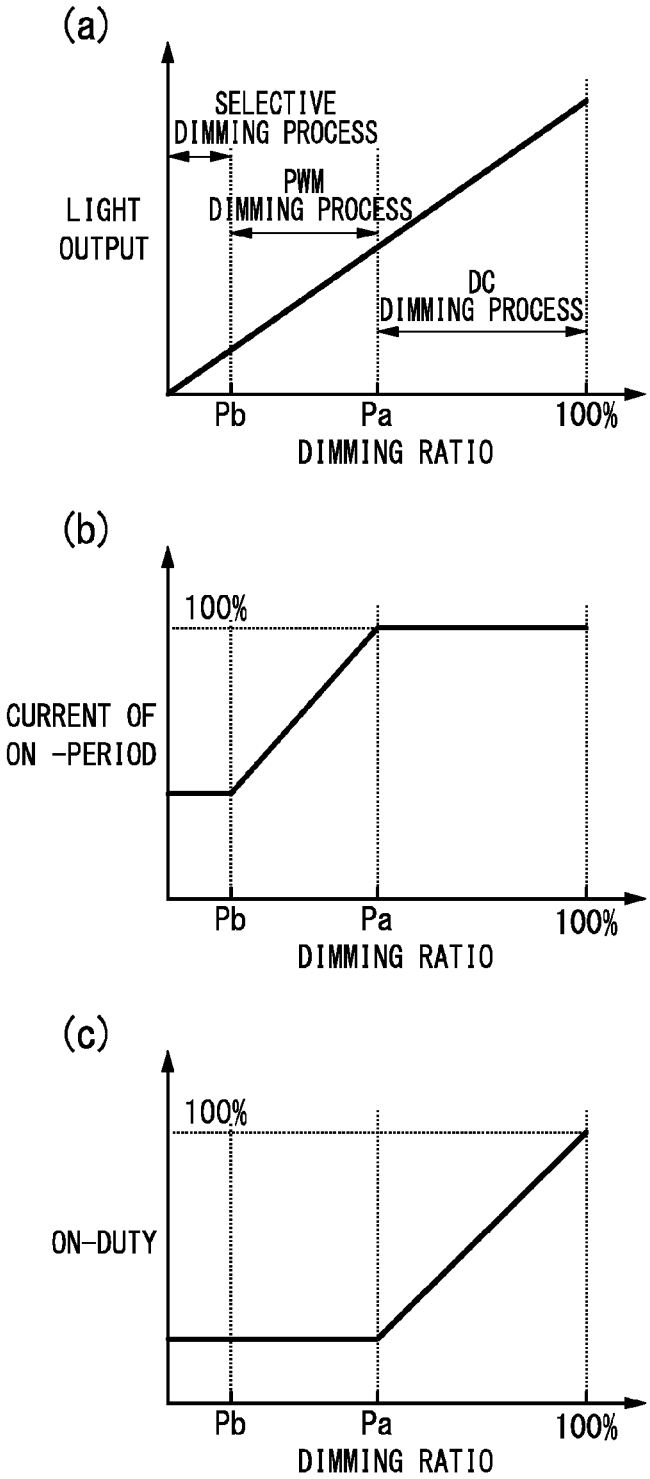
FIG. 5 is a diagram illustrating dimming characteristics of the lighting apparatus of the second embodiment.

As shown in FIG. 5 (*a*) to (*c*), the microcomputer 5 is configured to, when the dimming ratio falls within the first dimming range (Pb to the upper limit of the whole range of the dimming ratio), vary the supply power to the light source 9 in accordance with the dimming ratio. For example, the upper limit of the whole range of the dimming ratio is 100%.

The first dimming range includes a plurality of dimming intervals. In the present embodiment, the first dimming range includes a first dimming interval and a second dimming interval. For example, the first dimming interval is defined as an interval of the dimming ratio of Pa to 100%. The second dimming interval is defined as an interval of the dimming ratio of Pb to Pa.

The first dimming interval is defined as an interval (PWM dimming interval) within which the microcomputer 5 performs the PWM dimming process. In other words, the microcomputer 5 keeps the lighting number and the supply current constant and varies the duty ratio in accordance with the dimming ratio.

When the dimming ratio falls within the first dimming interval (Pa to the upper limit of the whole range of the dimming ratio), the microcomputer 5 adjusts the lighting number to a value (of the lighting number) associated with the first dimming interval (five, in the present embodiment) and changes the magnitude of the supply current to a value (of the magnitude of the supply current) associated with the first dimming interval (in the present embodiment, a maximum magnitude of the supply current associated with the second dimming interval).

In addition, the microcomputer 5 adjusts the duty ratio of the current (supply current) supplied to the light source 9 to a value which is selected from a range of the duty ratio associated with the first dimming interval in accordance with the dimming ratio. For example, the microcomputer 5 controls each of the switching elements Q1 to Q5 of the switching circuit 7 such that the duty ratio is equivalent to a value corresponding to the dimming ratio within the range of the duty ratio associated with the first dimming interval. In the first dimming interval, the microcomputer 5 increases the duty ratio in response to an increase in the dimming ratio (see FIG. 5 (*c*)).

The second dimming interval is defined as an interval (DC dimming interval) within which the microcomputer 5 performs the DC dimming process. In other words, the microcomputer 5 keeps the lighting number and the duty ratio constant and varies the magnitude of the supply current in accordance with the dimming ratio.

When the dimming ratio falls within the second dimming interval (Pb to Pa), the microcomputer 5 adjusts the lighting number to a value (of the lighting number) associated with the second dimming interval (five, in the present embodiment) and changes the duty ratio to a value (of the duty ratio) associated with the second dimming interval (in the present embodiment, a minimum value of the duty ratio associated with the first dimming interval).

In addition, the microcomputer 5 adjusts the magnitude of the current (supply current) supplied to the light source 9 to a value which is selected from a range of the supply current associated with the second dimming interval in accordance with the dimming ratio. For example, the microcomputer 5 adjusts the designated current (output current) of the constant current circuit 6A such that the magnitude of the supply current is equivalent to a value corresponding to the dimming ratio within the range of the supply current associated with the second dimming interval. In the second dimming interval, the microcomputer 5 increases the supply current in response to an increase in the dimming ratio (see FIG. 5 (*b*)).

The second dimming range defines an interval (a selective dimming interval) in which the microcomputer 5 performs the selective dimming process. In brief, the microcomputer 5 is configured to maintain the supply power to the light source 9 and vary, in accordance with the dimming ratio, the lighting number. For example, the lower limit of the whole range of the dimming ratio is 0%.

In the second dimming range, the microcomputer 5 maintains the magnitude and the duty ratio of the supply current, thereby maintaining the supply power. Therefore, the microcomputer 5 is configured to, when the dimming ratio falls within the second dimming range, adjust the duty ratio to a value (of the duty ratio) associated with the second dimming range (in the present embodiment, the minimum value of the duty ratio associated with the first dimming interval), and adjust the magnitude of the supply current to a value (of the magnitude of the supply current) associated with the second dimming range (in the present embodiment, the minimum value of the magnitude of the supply current associated with the second dimming interval).

Additionally, the microcomputer 5 is configured to adjust the lighting number to a value associated with the dimming ratio within the range of the lighting number associated with the second dimming range. For example, the microcomputer 5 controls each of the switching elements Q1 to Q5 of the switching circuit 7 such that the lighting number is identical to a value associated with the dimming ratio within the range of the lighting number associated with the second dimming range. The microcomputer 5 is configured to decrease the lighting number in response to a decrease in the dimming ratio in the second dimming range.

In brief, the microcomputer 5 is configured to, when the dimming ratio falls within the second dimming range (the lower limit of the whole range of the dimming ratio to Pb) different from the first dimming range (Pb to the upper limit of the whole range of the dimming ratio), vary, in accordance with the dimming ratio, the lighting number defined as the number of the light emitting elements (the LED loads 4) to be lit. The microcomputer 5 is configured to vary the lighting number by use of the switching circuit 7.

For example, to change the luminance smoothly, the dimming signal from the dimmer 1 is represented by the value in the range of 256×256=65536. In brief, the numerical data in a range of 0 to 65535 is used as the dimming level of the dimming signal. The dimming level of 0 means extinction, and the dimming level of 65535 means 100% lighting.

When the signal outputted from the dimmer 1 indicates the maximum level of 65535, the microcomputer 5 turns on the switching elements Q1 to Q5 and instructs the constant current circuit 6A to supply the maximum current (the current of 1 [A]). As a result, the current of 1 [A] flows through the LED loads 4.

Next, when the dimming ratio is decreased to about 50% and the microcomputer 5 receives the dimming signal indicative of the level of 32768, the microcomputer 5 turns on and off the switching element Q5 to adjust the duty ratio to 50%. As a result, the luminance (light output) of the LED loads 4 (4-1 to 4-5) is decreased down to about 50% of its maximum.

When the dimming ratio is further decreased down to half thereof and the microcomputer 5 receives the dimming signal indicative of the level of 16384, the microcomputer 5 adjusts the duty ratio to 25%. As a result, the luminance of the LED loads 4 (4-1 to 4-5) is decreased down to about 25% of its maximum.

Upon receiving the dimming signal indicative of the level of 6554, the microcomputer 5 adjusts the duty ratio to 10%. As a result, the luminance of the LED loads 4 (4-1 to 4-5) is decreased down to about 10% of its maximum.

In this procedure, when a repeating frequency determining timings of turning on and off the switching element Q5 is relatively low, flickering will occur. Therefore, generally, the repeating frequency not less than 60 Hz is necessary.

When the repeating frequency is 100 Hz, a human may not feel flickering. However, to prevent an occurrence of flickering in a video image, it is necessary to turn on and off the LED load 4 at a higher frequency (e.g., 300 Hz or more).

For example, to prevent the occurrence of flickering, the repeating frequency is selected to be 1000 Hz. In this instance, even when the duty ratio is decreased down to 10%, the pulse width (duration) in the on-period is 100 μs. Therefore, it is possible to successfully perform the dimming control by use of a normal microcomputer. Further, when the response speed of the switching element Q1 is 10 ns, an effect on the dimming ratio is negligibly small.

When the dimming ratio is further decreased down to half thereof and the microcomputer 5 receives the dimming signal indicative of the level of 3277, the microcomputer 5 instructs the constant current circuit 6A to supply a current of 500 mA which is a half of the present current. As a result, the current value is decreased down to 50% of the maximum current value (the light output of the LEDs is decreased to 5% of its maximum).

When the dimming ratio is further decreased and the microcomputer 5 receives the dimming signal indicative of the level of 655, the microcomputer 5 instructs the constant current circuit 6A to supply a current of 100 mA. Consequently, it is possible to decrease the current value down to 10% of the maximum current value (the light output of the LEDs is decreased to 1% of its maximum).

Subsequently, when the dimming ratio is further decreased down, the switching element Q5 is kept turned off (in this situation, the on-off control is preformed by use of the switching element Q4). Therefore, the number of the LED loads (or the LED load groups) connected in series is decreased from five to four. Thus, the light output of the LED loads is reduced to 0.8% of its maximum.

Further, when the switching element Q4 is further kept turned off (in this situation, the on-off control is preformed by use of the switching element Q3), the light output of the LED loads is reduced to 0.6% of its maximum. When the switching elements Q3 and Q2 are further kept turned off (in this situation, the on-off control is preformed by use of the switching element Q1), it is possible to perform the dimming control at 0.2%.

FIG. 5 shows an operation of the lighting apparatus 3 of the present embodiment. FIG. 5 (*a*) shows a relation between the level of the dimming signal output (the dimming ratio) and the light output. FIG. 5 (*b*) shows a relation between the level of the dimming signal output and the current (peak value) of the on-period (a period in which a current flows through the LED load 4) flowing through the LED load 4. FIG. 5 (*c*) shows a relation between the level of the dimming signal output and the on-duty (the duty ratio of the current supplied to the LED load 4). With employing the above configuration, it is possible to provide the LED dimming apparatus capable of successfully operating at the lowered dimming level.

In the lighting apparatuses 3 of the first and second embodiments, the selective dimming process is performed after the DC dimming process and the PWM dimming process are performed. However, the selective dimming process may be performed after the DC dimming process or the PWM dimming process is performed. In this modification, the same effect can be obtained.

Alternatively, the DC dimming process and the PWM dimming process may be performed in parallel. The selective dimming process may be performed in combination with the DC dimming process and/or the PWM dimming process. The aforementioned modifications can produce the same effect.

Alternatively, the lighting apparatus 3 includes a circuit for constant current control and constant voltage control such as a flyback DC/DC converter and a forward DC/DC converter.

Third Embodiment

Figure 6:
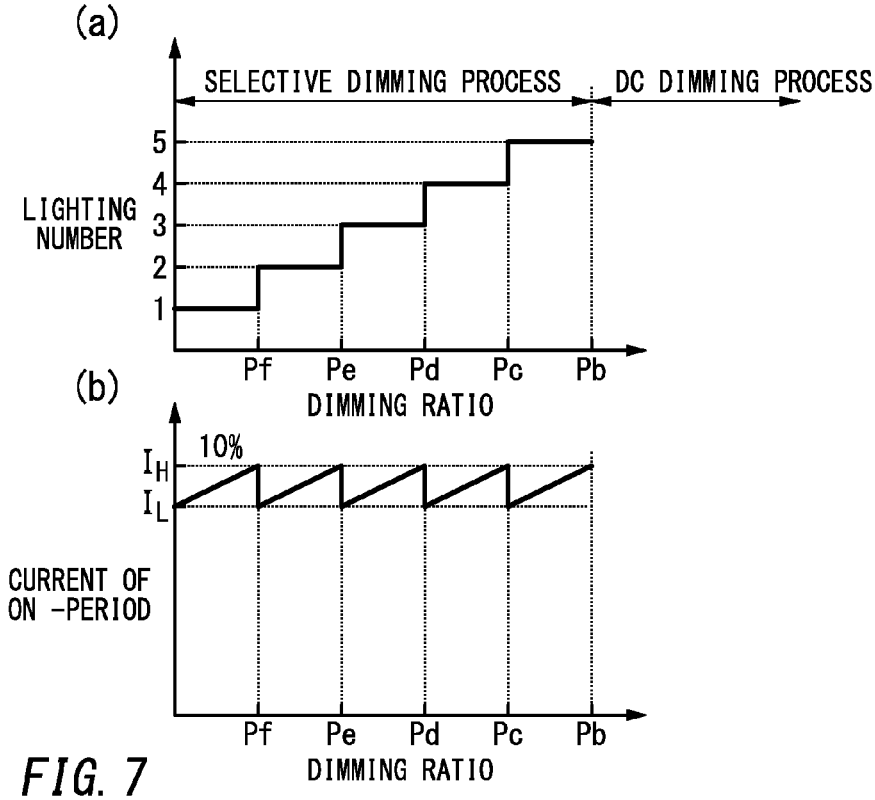
FIG. 6 is a diagram illustrating dimming characteristics of the lighting apparatus of the third embodiment.
Figure 7:
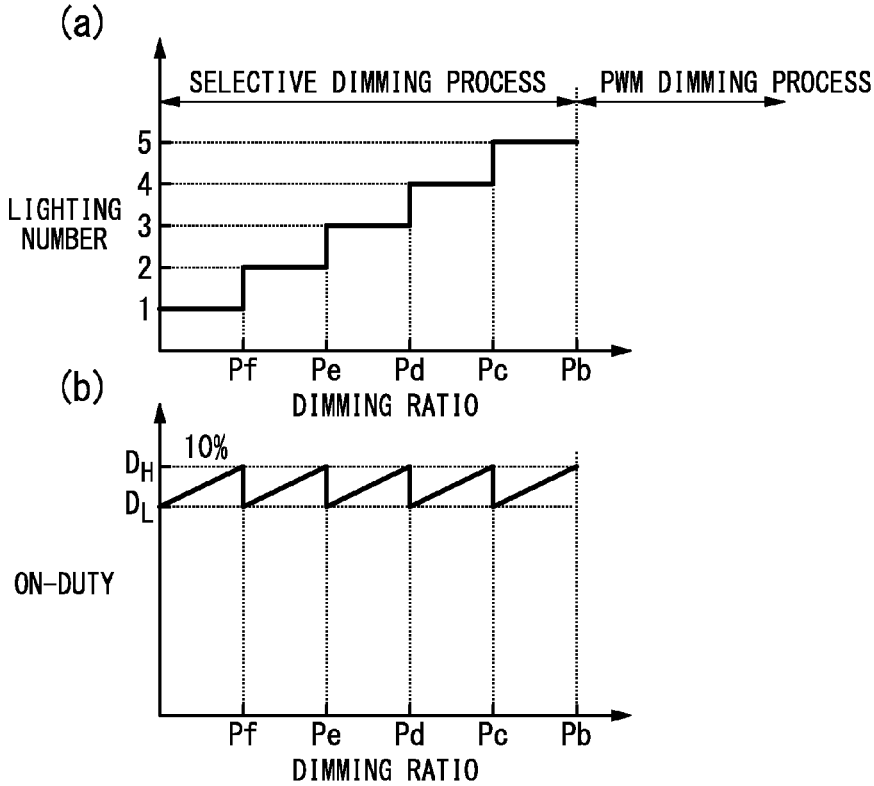
FIG. 7 is a diagram illustrating dimming characteristics of the modified example of the lighting apparatus of the third embodiment.
Figure 8:
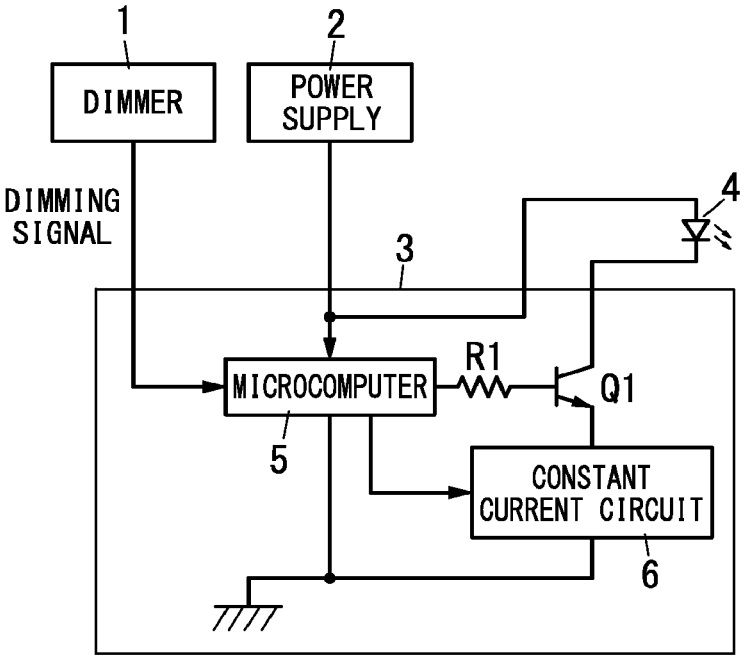
FIG. 8 PRIOR ART
FIG. 8 is a block diagram illustrating the prior lighting apparatus.

The lighting apparatus (LED lighting apparatus) 3 of the present embodiment has a circuit configuration similar to those of the lighting apparatuses 3 of the first and second embodiments, and therefore explanations thereof are deemed unnecessary. The operation of the lighting apparatus 3 of the present embodiment is explained with reference to FIGS. 6 and 7. FIGS. 6 and 7 show the operations relating to the low dimming ratio (low dimming level).

As shown in FIGS. 6 (*a*) and (*b*), the second dimming range (the lower limit of the whole range of the dimming ratio to Pb) includes a plurality of (five in the present embodiment) auxiliary dimming intervals associated with the different lighting numbers respectively. For example, the second dimming range includes the first auxiliary dimming interval (Pc to Pb), the second auxiliary dimming interval (Pd to Pc), the third auxiliary dimming interval (Pe to Pd), the fourth auxiliary dimming interval (Pf to Pe), and the fifth auxiliary dimming interval (the lower limit of the whole range of the dimming ratio to Pf).

When the auxiliary dimming interval is designated, the microcomputer 5 (the dimming control unit) adjusts the lighting number to a value (of the lighting number) associated with the designated auxiliary dimming interval. Further, the microcomputer 5 changes unit power supplied to each light emitting element (LED load) 4 to a value associated with the dimming ratio within a range of the unit power associated with the designated auxiliary dimming interval.

In the instance shown in FIG. 6, the microcomputer 5 varies the unit power by means of adjusting the magnitude of the current (unit current) supplied to each of the light emitting elements (LED loads) 4 by use of the current adjustment unit (e.g., the constant voltage circuit 6 in the first embodiment and the constant current circuit 6A in the second embodiment).

In brief, the auxiliary dimming interval is defined as an interval (DC dimming interval) within which the microcomputer 5 performs the DC dimming process. The microcomputer 5 keeps the lighting number and the duty ratio constant and varies the magnitude of the unit current in accordance with the dimming ratio. Further, the microcomputer 5 is configured to decrease the unit current (unit power) in response to a decrease in the dimming ratio in the auxiliary dimming interval.

The microcomputer 5 adjusts the lighting number to a value (of the lighting number) associated with the auxiliary dimming interval and adjusts the duty ratio to a value (of the duty ratio) associated with the auxiliary dimming interval. Further, in the auxiliary dimming interval, the microcomputer 5 adjusts the magnitude of the unit current to a value associated with the dimming ratio within the range of the unit current associated with the auxiliary dimming interval.

The lighting number associated with the first auxiliary dimming interval (Pc to Pb) is five. The lighting number associated with the second auxiliary dimming interval (Pd to Pc) is four. The lighting number associated with the third auxiliary dimming interval (Pe to Pd) is three. The lighting number associated with the fourth auxiliary dimming interval (Pf to Pe) is two. The lighting number associated with the fifth auxiliary dimming interval (the lower limit of the whole range of the dimming ratio to Pf) is one.

The plurality of the auxiliary dimming intervals are associated with the same duty ratio. For example, the duty ratio associated with the auxiliary dimming interval is identical to a minimum value of the duty ratio in the PWM dimming interval (e.g., the second dimming interval in the first embodiment and the first dimming interval in the second embodiment) of the first dimming range. Alternatively, the plurality of the auxiliary dimming intervals may be associated with the different duty ratios.

The plurality of the auxiliary dimming intervals are associated with the same range of the unit current. For example, the range of the unit current associated with the auxiliary dimming interval has a lower limit $I_L$ and an upper limit $I_H$. Therefore, the plurality of the auxiliary dimming intervals has the same range of the unit current. Alternatively, the plurality of the auxiliary dimming intervals may be associated with the different ranges of the unit current. Besides, for example, the upper limit $I_H$ of the range of the unit current is not greater than a value corresponding to a minimum value of the supply current in the DC dimming interval of the first dimming range.

For example, when the dimming ratio falls within the second auxiliary dimming interval, the microcomputer 5 adjusts the lighting number to four, and adjusts the duty ratio to the minimum value of the duty ratio of the PWM dimming interval in the first dimming range. Further, the microcomputer 5 varies the magnitude of the unit current to a value associated with the dimming ratio within the range of the unit current of $I_L$ to $I_H$ associated with the second auxiliary dimming interval.

When the dimming ratio is identical to a minimum value of the dimming ratio in the second auxiliary dimming interval, the lighting number is four associated with second auxiliary dimming interval, and the duty ratio is the minimum value of the duty ratio in the PWM dimming interval, and the magnitude of the unit current is $I_L$.

When the dimming ratio is decreased down to a maximum value of the dimming ratio in the third auxiliary dimming interval, the lighting number is decreased down to three associated with the third auxiliary dimming interval, and the duty ratio is not changed, and the magnitude of the unit current is increased up to $I_H$.

In brief, although the lighting number is reduced from four to three, the magnitude of the unit current is increased from $I_L$ to $I_H$. Notably, the upper limit $I_H$ and the lower limit $I_L$ of the unit current are selected such that the luminance of the light source 9 is continuously decreased with a decrease in the dimming ratio. In other words, the range of the unit current (i.e., the range of the unit power) is determined such that a decrease in the luminance of the light source 9 in the process of decreasing the lighting number is not greater than a predetermined value. For example, the predetermined value is selected such that it is considered that the luminance of the light source 9 changes continuously.

FIG. 6 shows a diagram illustrating dimming characteristics of the lighting apparatus 3 of the present embodiment. In the range of the dimming ratio of Pb to Pc, the lighting apparatus 3 decreases the current of the on-period such that the luminance changes continuously. When the dimming ratio becomes Pc, the lighting apparatus 3 decreases the lighting number of the LED loads by use of the selective dimming process and simultaneously increases the current of the on-period to maintain the continuity of the luminance. The similar control is performed with regard to the range of the dimming ratio Pc to the dimming ratio Pf.

The lighting apparatus 3 of the present embodiment as mentioned in the above further adjusts the current flowing through the semiconductor light emitting elements (the LED loads 4) by use of at least one of the DC dimming process and the PWM dimming process such that continuity of the luminance is not broken in a process of decreasing the lighting number of the semiconductor light emitting elements (the LED loads 4).

In other words, in the lighting apparatus 3 of the present embodiment, the dimming control unit (the microcomputer 5) is configured to adjust the supply power such that a decrease in the luminance of the light source 9 in a process of decreasing the lighting number is not greater than the predetermined value.

Further, in the lighting apparatus 3 of the present embodiment, the predetermined value is selected such that it is considered that the luminance of the light source 9 changes continuously. Besides, this configuration is optional.

Especially, in the lighting apparatus 3 of the present embodiment, the second dimming range includes a plurality of the auxiliary dimming intervals associated with the different lighting numbers respectively. The dimming control unit (the microcomputer 5) is configured to, when the auxiliary dimming interval is designated, adjust the lighting number to a value associated with the designated auxiliary dimming interval and change unit power supplied to each light emitting element (the LED load 4) to a value associated with the dimming ratio within a range of the unit power associated with the designated auxiliary dimming interval. Besides, this configuration is optional.

Further, in the lighting apparatus 3 of the present embodiment, the range of the unit power is determined such that a decrease in the luminance of the light source 9 in the process of decreasing the lighting number is not greater than a predetermined value. Besides, this configuration is optional.

Further, in the lighting apparatus 3 of the present embodiment, the predetermined value is selected such that it is considered that the luminance of the light source 9 changes continuously. Besides, this configuration is optional.

According to the present embodiment, it is possible to provide the LED dimming apparatus capable of maintaining the continuity of the luminance even when the dimming level is lowered.

FIG. 7 shows a diagram illustrating dimming characteristics of a modification of the lighting apparatus 3 of the present embodiment. The lighting apparatus 3 is configured to adjust the on-duty such that the continuity of the luminance is not broken. According to this modification, it is possible to obtain the same effect as the configuration in which the current of the on-period is adjusted to maintain the continuity of the luminance.

In brief, in the instance shown in FIG. 7, the microcomputer 5 varies the unit power by means of adjusting the duty ratio of the current supplied to each of the light emitting elements (the LED loads 4) by use of the switching circuit 7.

In brief, the auxiliary dimming interval is defined as an interval (PWM dimming interval) within which the microcomputer 5 performs the PWM dimming process. The microcomputer 5 keeps the lighting number and the magnitude of the unit current constant and varies the duty ratio of the unit current (identical to the duty ratio of the supply current) in accordance with the dimming ratio. Further, the microcomputer 5 is configured to decrease the duty ratio (unit power) in response to a decrease in the dimming ratio in the auxiliary dimming interval.

The microcomputer 5 adjusts the lighting number to a value (of the lighting number) associated with the auxiliary dimming interval and adjusts the magnitude of the unit current to a value (of the magnitude of the unit current) associated with the auxiliary dimming interval. Further, in the auxiliary dimming interval, the microcomputer 5 adjusts the duty ratio of the unit current to a value associated with the dimming ratio within the range of the duty ratio associated with the auxiliary dimming interval.

The plurality of the auxiliary dimming intervals are associated with the same magnitude of the unit current. For example, the magnitude of the unit current associated with the auxiliary dimming interval is identical to a minimum value of the supply current (i.e., the unit current corresponding to the minimum supply current) in the DC dimming interval (e.g., the first dimming interval in the first embodiment and the second dimming interval in the second embodiment) of the first dimming range. Alternatively, the plurality of the auxiliary dimming intervals may be associated with the different magnitudes of the unit current.

The plurality of the auxiliary dimming intervals are associated with the same range of the duty ratio. For example, the range of the duty ratio associated with the auxiliary dimming interval has a lower limit $D_L$ and an upper limit $D_H$. Therefore, the plurality of the auxiliary dimming intervals has the same range of the duty ratio. Alternatively, the plurality of the auxiliary dimming intervals may be associated with the different ranges of the duty ratio. Besides, for example, the upper limit $D_H$ of the range of the duty ratio is not greater than a value corresponding to a minimum value of the duty ratio in the PWM dimming interval of the first dimming range.

For example, when the dimming ratio falls within the second auxiliary dimming interval, the microcomputer 5 adjusts the lighting number to four, and adjusts the magnitude of the unit current to the value corresponding to the minimum value of the supply current of the DC dimming interval in the first dimming range. Further, the microcomputer 5 varies the duty ratio to a value associated with the dimming ratio within the range of the duty ratio of $D_L$ to $D_H$ associated with the second auxiliary dimming interval.

When the dimming ratio is identical to a minimum value of the dimming ratio in the second auxiliary dimming interval, the lighting number is four associated with second auxiliary dimming interval, and the magnitude of the unit current is the value corresponding to the minimum value of the supply current in the DC dimming interval, and the duty ratio is $D_L$.

When the dimming ratio is decreased down to a maximum value of the dimming ratio in the third auxiliary dimming interval, the lighting number is decreased down to three associated with the third auxiliary dimming interval, and the magnitude of the unit current is not changed, and the duty ratio is increased up to $D_H$.

In brief, although the lighting number is reduced from four to three, the duty ratio is increased from $D_L$ to $D_H$. Notably, the upper limit $D_H$ and the lower limit $D_L$ of the duty ratio are selected such that the luminance of the light source 9 is continuously decreased with a decrease in the dimming ratio. In other words, the range of the duty ratio (i.e., the range of the unit power) is determined such that a decrease in the luminance of the light source 9 in the process of decreasing the lighting number is not greater than a predetermined value. For example, the predetermined value is selected such that it is considered that the luminance of the light source 9 changes continuously.

Therefore, the modification illustrated in FIG. 7 can produce the same effect as the lighting apparatus 3 of the present embodiment shown in FIG. 6.

The invention claimed is:

1. A lighting apparatus comprising a dimming control unit configured to control, in accordance with a dimming ratio, a light source including a plurality of light emitting elements designed to emit light in response to DC power, wherein said dimming control unit is configured to, when the dimming ratio falls within a first dimming range, vary supply power to said light source in accordance with the dimming ratio, and said dimming control unit is configured to, when the dimming ratio falls within a second dimming range different from the first dimming range, vary, in accordance with the dimming ratio, a lighting number defined as the number of the light emitting elements to be lit.

2. A lighting apparatus as set forth in claim 1, wherein the second dimming range has an upper limit not greater than a lower limit of the first dimming range.

3. A lighting apparatus as set forth in claim 2, wherein said dimming control unit is configured to decrease the lighting number in response to a decrease in the dimming ratio in the second dimming range.

4. A lighting apparatus as set forth in claim 1, wherein said dimming control unit is configured to adjust the supply power such that a decrease in luminance of the light source in a process of decreasing the lighting number is not greater than a predetermined value.

5. A lighting apparatus as set forth in claim 4, wherein the predetermined value is selected such that it is considered that the luminance of the light source changes continuously.

6. A lighting apparatus as set forth in claim 1, wherein the second dimming range includes a plurality of auxiliary dimming intervals associated with the different lighting numbers respectively, and said dimming control unit is configured to, when the auxiliary dimming interval is designated, adjust the lighting number to a value associated with the designated auxiliary dimming interval and change unit power supplied to each light emitting element to a value associated with the dimming ratio within a range of the unit power associated with the designated auxiliary dimming interval.

7. A lighting apparatus as set forth in claim 6, wherein a range of the unit power is determined such that a decrease in the luminance of the light source in the process of decreasing the lighting number is not greater than a predetermined value.

8. A lighting apparatus as set forth in claim 7, wherein the predetermined value is selected such that it is considered that the luminance of the light source changes continuously.

9. A lighting apparatus as set forth in claim 1, wherein said dimming control unit is configured to vary the supply power by means of adjusting at least one of a magnitude and a duty ratio of a current supplied to the light source.

10. A lighting apparatus as set forth in claim 1, further comprising a lighting circuit configured to light the light source, wherein said dimming control unit is configured to control said light source by use of said lighting circuit.

11. A lighting apparatus as set forth in claim 10, wherein said lighting circuit comprises:

a current adjustment unit configured to supply currents to the plurality of the light emitting elements respectively; and a switch unit including a plurality of switching elements respectively connected in series with the plurality of the light emitting elements.

12. A lighting apparatus as set forth in claim 11, wherein said dimming control unit is configured to vary the supply power by means of adjusting a duty ratio of a current supplied to the light source by use of said switch unit.

13. A lighting apparatus as set forth in claim 11, wherein said dimming control unit is configured to vary the lighting number by use of said switch unit.

14. A lighting apparatus as set forth in claim 11, wherein said dimming control unit is configured to vary the supply power by means of adjusting a magnitude of a current supplied to the light source by use of said current adjustment unit.

15. A lighting apparatus as set forth in of claim 1, wherein said dimming control unit is configured to receive the dimming ratio from a dimming signal provided from a dimmer.

* * * * *